United States Patent [19]

Meschkat et al.

[11] 4,268,401

[45] May 19, 1981

[54] LIQUID DETERGENT COMPOSITIONS HAVING WASHING AND SOFTENING PROPERTIES

[75] Inventors: Ursula Meschkat, Wiesbaden-Biebrich; Rudolf Bimczok, Mainz-Gonsenheim, both of Fed. Rep. of Germany

[73] Assignee: Blendax-Werke R. Schneider GmbH & Co., Mainz, Fed. Rep. of Germany

[21] Appl. No.: 833,971

[22] Filed: Sep. 16, 1977

Related U.S. Application Data

[63] Continuation of Ser. No. 678,655, Apr. 20, 1976, abandoned.

[51] Int. Cl.[2] ..... C11D 1/62; C11D 1/835; D06M 13/46

[52] U.S. Cl. ..... 252/8.8; 252/8.9; 252/542; 252/547; 252/DIG. 14

[58] Field of Search ..... 252/541, 8.8, 8.9, 547, 252/542, DIG. 1, DIG. 14; 8/137

[56] References Cited

U.S. PATENT DOCUMENTS

| | | | |
|---|---|---|---|
| 3,689,424 | 9/1972 | Berg et al. | 252/547 X |
| 3,793,196 | 2/1974 | Okazaki et al. | 252/8.8 |
| 3,862,045 | 1/1975 | Sato et al. | 252/8.8 |
| 3,951,879 | 4/1976 | Wixon | 252/547 |
| 3,959,157 | 5/1976 | Inamorato | 252/8.8 |

*Primary Examiner*—P. E. Willis, Jr.
*Attorney, Agent, or Firm*—Connolly and Hutz

[57] ABSTRACT

Disclosed is a liquid fine washing agent, which, in addition to good washing properties, has an excellent fiber-caring effect and, in particular, bestows a soft feel to textiles treated therewith. The washing agent achieving these objectives contains about 7 to 40% by weight of at least one nonionic surface-active agent, especially at least one $C_{10}$–$C_{20}$-alkylpolyglycol ether and/or $C_6$–$C_{20}$-alkylphenolpolyglycol ether; about 3 to 15% by weight of at least one $C_8$–$C_{20}$ fatty acid polyglycol diester; and about 1 to 7% by weight of a quaternary ammonium compound with textile-softening properties, especially a di-$C_{10}$–$C_{22}$-alkyldimethyl or - ethylammonium halide.

14 Claims, No Drawings

LIQUID DETERGENT COMPOSITIONS HAVING WASHING AND SOFTENING PROPERTIES

This application is a continuation of application Ser. No. 678,655 filed Apr. 20, 1976 now abandoned.

FIELD OF THE INVENTION

It has already been proposed, particularly in automatic washing machines, to go beyond the main washing cycle, whereby the laundry is washed with a tenside-containing, and preferably an anion-active detergent in a so-called softening rinse cycle, where the laundry is contacted with a cation-active compound, most commonly a quaternary ammonium compound.

It has also been proposed to incorporate the washing and softening action into a single detergent composition. However, the practical utilization of these proposals generally failed, for one thing because anion-active and cation-active substances are incompatible and as a rule react by the formation of a deposit.

In addition, it has also been proposed (e.g., in the German Published Application 1,220,956) to prepare detergents with a softening effect by the compatible combination of a non-ionic surface-active agent with a cation-active softener in a quaternary nitrogen base.

The compositions previously proposed for this purpose, however, have the drawback that their washing effect is either generally too insignificant or a satisfactory softening effect cannot be obtained. Thus a demand exists for a single, compatible composition which will provide the desired washing and softening effect, both to a high degree.

BRIEF SUMMARY OF THE INVENTION

It has now been found that a liquid fine washing agent may be prepared having both excellent washing properties as well as outstanding fiber-caring, particularly soft-rinsing, properties if there is added to an aqueous base a composition comprising about 7 to 40% by weight of at least one non-ionic surface-active agent, especially at least one $C_{10}$–$C_{20}$-alkylpolyglycol ether and/or $C_6$–$C_{20}$-alkylphenolpolygylcol ether; about 3 to 15% by weight of at least one $C_8$–$C_{20}$ fatty acid polyglycol diester; and about 1 to 7% by weight of at least one cationic component with textile-softening properties, especially a di-$C_{10}$–$C_{20}$-alkyldimethyl- or -ethylammonium halide.

DETAILED DESCRIPTION OF THE INVENTION

The novel compositions according to the invention contain preferably alkylpolyglycol ethers which have 10–16 carbon atoms in the alkyl radical and are alkoxylated with 3 to 10 moles of ethylene oxide and/or propylene oxide (in the case both ethylene oxide and propylene oxide units are present, the ethers may be random or block copolymers). Outstandingly suitable for use in these novel compositions are $C_{10}$–$C_{12}$-alkylpolyglycol ethers with 5 to 7 ethylene oxide groups in the molecule.

Suitable $C_6$–$C_{20}$-alkylphenolpolyglycol ethers which may replace some or all of the alkylpolyglycol ethers, for example, are those having the formula:

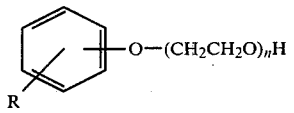

wherein R is a $C_6$–$C_{20}$-alkyl group and particularly a $C_8$–$C_{16}$-alkyl group and $n$ is a whole number from 3 to 15, and particularly 5 to 10. Random or block copolymers may be employed when mixed ethylene and propylene oxide units are present.

The polyglycol ethers to be employed can also be selected from the known polyether glycols, e.g. the block polymers of the general structure $HO(C_2H_4O)_x$—$(C_3H_6O)_y$—$(C_2H_4O)_zH$ or $HO(C_3H_6O)_n$—$(C_2H_4O)_m$—$(C_3H_6O)_nH$ whose molar weight is between about 1,000 and 15,000, and which are sold, for example, under the trade name "Pluronic®" (see McCutcheons, *Detergents & Emulsifiers,* 1974 Ed., pp. 137–138). In these formulae, typically $x$ is a whole number between 10 and 40, especially 26 and 30; $y$ and $z$ are whole numbers between 10 and 60, especially 30 and 40; $m$ is a whole number from 10 to 50, especially 36 to 40 and $n$ is a whole number from 10 to 40, especially 20 to 30. The preparation and the properties of these compounds are described in detail by K. Lindner, *Tenside, Textilhilfsmittel, Waschrohstoffe* (Tensides, Textile Aids, Washing Raw Materials) 2nd Ed. (Stuttgart, 1964), pp. 1052–1057.

Suitable polyglycol ethers, furthermore, are the fatty acid amide polyglycol ethers whose preparation and properties are described by K. Lindner, *Tenside, Textilhilfsmittel, Waschrohstoffe,* 2nd Ed. (published by Wissenschaftliche Verlagsgesellschaft m.b.H., Stuttgart, 1964), pp. 912–914.

Preferred fatty acid amide polyglycol ethers are those having the structure:

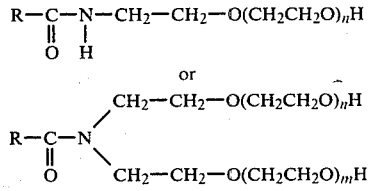

wherein n and m are whole numbers from 1 to 20 and preferably 5 to 15, and R is a higher alkyl radical with preferably 8 to 20 carbon atoms.

Needless to say, the corresponding propoxylates may also be employed in place of the ethoxylation products. Suitable commercial products, for example, are known under the name "Dionil®" of Chemische Werke Huels.

As $C_8$–$C_{20}$-fatty acid polyglycol diesters, the esters of unsaturated fatty acids, e.g., oleic acid, are particularly suitable. The polyglycol portion of the diester preferably contains ethylene and/or propylene oxide units.

The fatty acid polyglycol ether diester used in this invention has preferably a molar weight of about 200 to about 800; a preferred fatty acid polyglycol diester is polyethylene glycol-600-dioleate.

A particularly suitable quaternary ammonium compound has been shown to be a di-$C_{10}$–$C_{22}$-alkyldimethyl or ethyl ammonium chloride or-bromide, as sold, for example, by the company Farbwerke Hoechst AG under the trade name "Praepagen WKT".

Also quaternized imidazoline derivatives of the general formula:

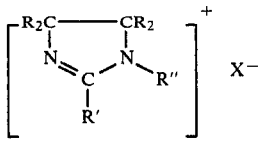

wherein R is H or an optionally substituted alkyl group with 1 to 18 carbon atoms, R' is an alkyl group with 8 to 22 carbon atoms, R'' is a lower alkyl group and X is a monovalent anionic group, may be used as textile-softening agents, as well as long-chain alkyl pyridinium halides.

These compounds and their textile-softening properties are well-known and are described by K. Lindner, *Tenside, Textilhilfsmittel, Waschrohstoffe,* 2nd Ed., Vol. 1, pp. 987–995.

Suitable products are sold, for example, by the companies REWO, Schlüchtern (Germany) under the name "Steinaquat", Servo B.V. under the name "Servamine KOV 4342 B", Ashland Chemical Co. under the name "Varisoft", especially "Varisoft 475" and Dutton & Reinisch Ltd. under the name "Loraquat M 5040".

The novel liquid fine washing agents with softening action may contain further agents known per se in liquid detergents. Thus, the addition of other non-ionic, cationic and/or amphoteric tensides is possible; however, out of the question is the addition of considerable amounts of anion-active tensides because of their incompatibility with the softening ammonium compounds. Further surface-active compounds which may be co-used are, for example, betaines or long-chain alkylaminocarboxylic acids, amine oxides, e.g., lauryldimethylamine oxide, further alkylene oxide adducts as well as polyglycol monoesters of saturated fatty acids, e.g., polyethyleneglycol monostearate. Furthermore, in small proportions, the customary builders and synthesizing agents may be present; also possible is the addition of other substances, known per se in washing agents, such as enzymes, brighteners, dirt carriers, urea, ethyl alcohol, propyl alcohol or isopropyl alcohol.

The novel agents may suitably also contain a preserving agent and, if desirable, dyestuffs, opacifiers, etc. In short, the novel compositions according to the present invention may contain in addition to the specified agents any of the well known ingredients commonly found in washing compositions and one skilled in the art may select such agents depending upon the precise properties desired.

The pH value of the novel liquid detergents is normally between about 2 and 7; the range of pH 3 to pH 6 is preferred.

The turbidity points of the novel detergents are commonly between about 10° C. and 65° C. and preferably between 30° C. and 55° C.

Below are given several examples for the illustration of the novel liquid fine detergents according to the invention, it being understood that such examples are not intended to limit the invention in any way.

EXAMPLE 1

| | |
|---|---|
| $C_{10}$–$C_{12}$-alkylpolyglycol ether (e.g. Marlipal KF$^R$ of Chemische Werke Huels) (6 ethylene oxide radicals/mole) | 13.0% by weight |
| polyethylene glycol-600-dioleate (e.g. Marlipal FS$^R$ of Chemische Werke Huels) | 7.0% by weight |
| difatty alkyl dimethylammonium chloride (e.g. Praepagen WKT$^R$ of Farbwerke Hoechst) | 4.0% by weight |
| formalin (40%) | 0.2% by weight |
| opacifier (e.g. fatty acid polyglycol ester) | 0.6% by weight |
| perfume | 0.6% by weight |
| staining solution (0.1% L-red solution) | 0.3% by weight |
| water | 74.3% by weight |

EXAMPLE 2

| | |
|---|---|
| $C_{10}$–$C_{12}$-alkylpolyglycol ether (e.g. Marlipal KF$^R$ of Chemische Werke Huels) (6 ethylene oxide radicals) | 14.0% by weight |
| polyethyleneglycol-600-dioleate (e.g. Marlipal FS$^R$ of Chemische Werke Huels) | 6.0% by weight |
| dicocos alkyl dimethylammonium chloride | 4.0% by weight |
| formalin (40%) | 0.2% by weight |
| opacifying agent (e.g. fatty acid polyglycol ester) | 0.6% by weight |
| perfume | 0.6% by weight |
| staining solution (0.1% L-red solution) | 0.3% by weight |
| water | 74.3% by weight |

Polyethyleneglycol-600-dioleate may be replaced by polypropyleneglycol-600-dimyristate.

EXAMPLE 3

| | |
|---|---|
| $C_{10}$–$C_{12}$-alkylpolyglycol ether (e.g. Marlipal KF$^R$ of Chemische Werke Huels) (6 ethylene oxide radicals) | 18.0% by weight |
| polyethyleneglycol-800-dioleate | 5.0% by weight |
| di-$C_{12}C_{16}$ fatty alkyldimethylammonium bromide | 3.5% by weight |
| formalin (40%) | 0.2% by weight |
| opacifying agent (e.g. fatty acid polyglycol ester) | 0.6% by weight |
| perfume | 0.6% by weight |
| staining solution (0.1% L-red solution) | 0.3% by weight |
| water | 71.8% by weight |

EXAMPLE 4

| | |
|---|---|
| $C_{10}$–$C_{12}$-alkyl polyglycol ether (e.g. Marlipal KF$^R$ of Chemische Werke Huels) (6 ethylene oxide radicals) | 18.0% by weight |
| polyethyleneglycol-600-dioleate (e.g. Marlipal FS$^R$ of Chemische Werke Huels) | 5.0% by weight |
| dilauryl dimethylammonium chloride | 3.5% by weight |
| carboxylmethylhydroxyethyl cellulose (e.g. Hercules$^R$ CMHEC of Hercules Powder) | 0.5% by weight |
| formalin (40%) | 0.2% by weight |
| opacifying agent (e.g. fatty acid polyglycol ester) | 0.6% by weight |
| perfume | 0.6% by weight |
| staining solution (0.1% L-red solution) | 0.3% by weight |

EXAMPLE 4-continued

| | |
|---|---|
| water | 71.3% by weight |

Dilauryl dimethylammonium chloride may be replaced by a quaternized fatty amide, e.g., the product "Consoft C" or "Consoft CPN" sold by the company Consos, Inc.

EXAMPLE 5

| | |
|---|---|
| $C_{10}$–$C_{12}$-alkylpolyglycol ether (e.g. Marlipal KF$^R$ of Chemische Werke Huels) (6 ethylene oxide radicals) | 18.0% by weight |
| polyethyleneglycol-1000-dioleate | 5.0% by weight |
| di-$C_{12}$–$C_{18}$-fatty alkyldimethylammonium chloride | 3.5% by weight |
| carboxylmethylhydroxyethyl cellulose (e.g. Hercules$^R$ CMHEC of Hercules Powder) | 1.0% by weight |
| formalin (40%) | 0.2% by weight |
| opacifying agent | 0.6% by weight |
| perfume | 0.6% by weight |
| staining solution (0.1% L-red solution) | 0.3% by weight |
| water | 70.8% by weight |

EXAMPLE 6

| | |
|---|---|
| $C_{10}$–$C_{12}$-alkylpolyglycol ether (8 ethylene oxide radicals) | 16.0% by weight |
| polyethyleneglycol-600-dioleate (e.g. Marlipal FS$^R$ of Chemische Werke Huels) | 5.0% by weight |
| nonylphenolpolyglycol ether (e.g. Arkopal N-060$^R$ of Farbwerke Hoechst) | 2.0% by weight |
| distearyl dimethylammonium chloride | 3.5% by weight |
| formalin (40%) | 0.2% by weight |
| opacifying agent (e.g. fatty acid polyglycol ester) | 0.6% by weight |
| perfume | 0.6% by weight |
| staining solution (0.1% L-red solution) | 0.3% by weight |
| water | 71.8% by weight |

Distearyl dimethylammonium chloride may be replaced by ditallow dimethyl ammonium methyl sulfate (e.g. "Ammonyx 2194") or ditallowdimethyl ammonium chloride.

EXAMPLE 7

| | |
|---|---|
| $C_{10}$–$C_{12}$-alkylpolyglycol ether (e.g. Marlipal KF$^R$ of Chemische Werke Huels) (6 ethylene oxide radicals) | 16.0% by weight |
| polyethyleneglycol-400-distearate | 3.0% by weight |
| nonylphenolpolyglycol ether (e.g. Arkopal N-060$^R$ of Farbwerke Hoechst) | 4.0% by weight |
| distearyl dimethylammonium chloride | 4.0% by weight |
| formalin (40%) | 0.2% by weight |
| opacifying agent (e.g. fatty acid polyglycol ester) | 0.6% by weight |
| perfume | 0.6% by weight |
| staining solution (0.1% L-red solution) | 0.3% by weight |
| water | 71.3% by weight |

EXAMPLE 8

| | |
|---|---|
| $C_{10}$–$C_{12}$-alkylpolyglycol ether (e.g. Marlipal KF$^R$ of Chemische Werke Huels) (6 ethylene oxide radicals) | 36.0% by weight |
| polyethyleneglycol-600-dioleate (e.g. Marlipal FS$^R$ of Chemische Werke Huels) | 10.0% by weight |

EXAMPLE 8-continued

| | |
|---|---|
| distearyl methylbenzylammonium chloride | 7.0% by weight |
| formalin | 0.2% by weight |
| opacifying agent (e.g. fatty acid polyglycol ester) | 0.6% by weight |
| perfume | 0.6% by weight |
| staining solution (0.1% L-red solution) | 0.3% by weight |
| water | 45.3% by weight |

EXAMPLE 9

| | |
|---|---|
| $C_{10}$–$C_{12}$-alkylpolyglycol ether (e.g. Marlipal KF$^R$ of Chemische Werke Huels) (6 ethylene oxide radicals) | 27.0% by weight |
| polyethyleneglycol-600-dilinolate | 7.5% by weight |
| difatty alkyldimethylammonium chloride (e.g. Praepagen WKT$^R$ of Farbwerke Hoechst) | 5.3% by weight |
| formalin (40%) | 0.2% by weight |
| opacifying agent | 0.6% by weight |
| perfume | 0.6% by weight |
| staining solution (0.1% L-red solution) | 0.3% by weight |
| water | 58.5% by weight |

EXAMPLE 10

| | |
|---|---|
| polyoxyethylene polyoxypropylene block polymer (e.g. Pluronic$^R$ L 62 of BASF-Wyandotte Co.) | 25.0% by weight |
| polyethyleneglycol-600-distearate | 6.5% by weight |
| distearyldimethylammonium chloride | 2.5% by weight |
| lauryldimethylamine oxide | 1.5% by weight |
| preserving agent (40% $CH_2O$ solution) | 0.3% by weight |
| perfume | 0.7% by weight |
| staining solution (0.1%) | 0.5% by weight |
| water | 63.0% by weight |

EXAMPLE 11

| | |
|---|---|
| fatty acid amidopolyglycol ether (Dionil$^R$ W 100 of Chemische Werke Huels) | 26.0% by weight |
| polyethyleneglycol-800-dioleate | 8.0% by weight |
| dimyristyl diethylammonium chloride | 2.0% by weight |
| preserving agent (40% $CH_2O$ solution) | 0.3% by weight |
| perfume | 0.7% by weight |
| staining solution (0.1%) | 0.5% by weight |
| water | 62.5% by weight |

EXAMPLE 12

| | |
|---|---|
| alkylphenolpolyglycol ether (9 ethylene oxide units; "Nonidet P80" of Shell Chem. U.K. Ltd.) | 22.5% by weight |
| polyethyleneglycol-600-dilaurate | 9.5% by weight |
| lauryldimethylamine oxide | 1.5% by weight |
| "Steinaquat M 5040" | 6.0% by weight |
| preserving agent (40% $CH_2O$ solution) | 0.3% by weight |
| sodium tripolyphosphate | 0.7% by weight |
| perfume | 0.8% by weight |
| pearl-essence agent | 0.2% by weight |
| water | 58.5% by weight |

"Steinaquat M 5040" (1-ethyl-1'-alkylamidoethyl-2-alkyl-imidazo- liniumethosulfate) may be replaced by dialkyl imidazolinium methosulfate, e.g. "Ammonyx 4080", by Onyx Chem. Co. or ditallowdimethylammonium methylsulfate (e.g. Ammonyx 2194) or ditallowdimethyl ammoniumchloride.

We claim:

1. An aqueous-based liquid washing agent having good washing and fabric softening action, comprising (a) from about 7 to about 40% by weight of at least one nonionic surface active agent, (b) from about 3 to about 15% by weight of at least one $C_8$–$C_{20}$-fatty acid polyglycol diester and (c) from about 1 to about 7.5% by weight of at least one quaternary ammonium compound with textile-softening properties.

2. The liquid washing agent according to claim 1 wherein the nonionic surface active agent is at least one member selected from the group consisting of a $C_{10}$–$C_{20}$-alkylpolyglycol ether, a $C_6$–$C_{20}$-alkylphenolpolyglycol ether, and mixtures thereof.

3. The liquid washing agent according to claim 2, wherein the $C_{10}$–$C_{20}$-alkylpolyglycol ether is a $C_{10}$–$C_{16}$-alkylpolyglycol ether with 3 to 10 ethylene oxide or propylene oxide groups per mole.

4. The liquid washing agent according to claim 3, wherein the $C_{10}$–$C_{20}$-alkylpolyglycol ether is a $C_{10}$–$C_{12}$-alkylpolyglycol ether with 5 to 7 ethylene oxide groups per mole.

5. The liquid washing agent according to claim 1, wherein the nonionic surface active agent is at least one polyether glycol selected from the group consisting of those having the formula:

$$HO-(C_2H_4O)_x-(C_3H_6O)_y-(C_2H_4O)_zH,$$

and $$HO-(C_3H_6O)_n-(C_2H_4O)_m-(C_3H_6O)_nH,$$

wherein $x$ is a whole number from 10 to 40,
$y$ and $z$ are whole numbers from 10 to 60,
$m$ is a whole number from 10 to 50, and
$n$ is a whole number from 10 to 40.

6. The liquid washing agent according to claim 1, wherein the nonionic surface active agent is at least one fatty acid amide polyglycol ether selected from the group consisting of those having the formula:

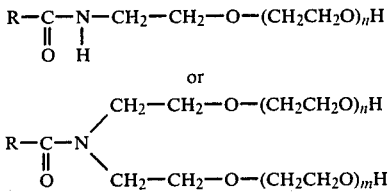

wherein $m$ and $n$ are whole numbers from 1 to 20, and R is an alkyl group with 8 to 20 carbon atoms.

7. The liquid washing agent according to claim 1, wherein the fatty acid polyglycol diester is an unsaturated fatty acid polyglycol diester.

8. The liquid washing agent according to claim 7, wherein the unsaturated fatty acid polyglycol diester is polyethyleneglycol-600-dioleate.

9. The liquid washing agent according to claim 1, wherein the quaternary ammonium compound is a di-$C_{10}$–$C_{22}$-alkyldimethyl- or -ethylammonium halide.

10. The liquid washing agent according to claim 9, wherein the di-$C_{10}$–$C_{22}$-alkyldimethyl- or -ethylammonium halide is a di-$C_{12}$–$C_{20}$-alkyldimethylammonium chloride.

11. The liquid washing agent according to claim 1, wherein the quaternary ammonium compound is an imidazoline derivative of the formula:

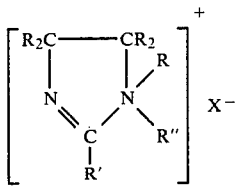

wherein R is H or an alkyl group with 1 to 18 carbon atoms, R′ is an alkyl group with 8 to 22 carbon atoms, R″ is a lower alkyl group, and X is a monovalent anionic group.

12. The liquid washing agent according to claim 1, containing from about 13 to about 20% by weight of a $C_{10}$–$C_{20}$-alkylpolyglycol ether, from about 5 to about 10% by weight of an unsaturated $C_{10}$–$C_{20}$-fatty acid polyglycol diester and from about 2 to about 4% by weight of a di-$C_{10}$–$C_{22}$-alkyldimethylammonium chloride.

13. The liquid washing agent according to claim 1, wherein component (a) is a mixture of a $C_{10}$–$C_{16}$-alkylpolyglycol ether with 5 to 7 ethylene oxide groups per mole and a $C_6$–$C_{20}$-alkylphenolpolyglycol ether having 5 to 10 ethylene oxide groups per molecule.

14. The liquid washing agent according to claim 1, containing:

(a) 7 to 40% by weight of a $C_{10}$–$C_{16}$-alkylpolyglycol ether with 3 to 10 ethylene oxide groups per mole,
(b) 3 to 15% by weight of a $C_8$–$C_{20}$ unsaturated fatty acid polyethyleneglycol diester, and
(c) 1 to 7.5% by weight of a di-$C_{12}$–$C_{20}$-alkyldimethylammonium chloride.

* * * * *

UNITED STATES PATENT OFFICE

CERTIFICATE OF CORRECTION

Patent No. 4,268,401 Dated May 19, 1981

Inventor(s) Ursula Meschkat et al

It is certified that error appears in the above-identified patent and that said Letters Patent are hereby corrected as shown below:

In the left hand column of the front page, between "[63]" and "[51]" the following should be inserted:

--[30] Foreign Application Priority Data

July 2, 1975 [DE] Fed.Rep. of Germany 2529444.4 --

Signed and Sealed this

*Third* Day of *August 1982*

[SEAL]

*Attest:*

GERALD J. MOSSINGHOFF

*Attesting Officer* *Commissioner of Patents and Trademarks*